United States Patent [19]

Elenbaas

[11] 4,366,458

[45] Dec. 28, 1982

[54] MERCURY DISPLACEMENT RELAY

[76] Inventor: George H. Elenbaas, 25526 N. Shore Dr., Elkhart, Ind. 46514

[21] Appl. No.: 327,243

[22] Filed: Dec. 3, 1981

[51] Int. Cl.[3] ..... H01H 29/16

[52] U.S. Cl. ..... 335/52; 335/47

[58] Field of Search ..... 335/47, 48, 49, 50, 335/51, 52, 53, 54, 55, 56, 57, 58, 82, 280; 200/186, 190, 199, 209, 210, 214

[56] References Cited

U.S. PATENT DOCUMENTS

| | | | |
|---|---|---|---|
| 1,930,094 | 10/1933 | Hatay | 335/52 |
| 1,967,954 | 7/1934 | Warnke | 335/52 |
| 1,971,934 | 8/1934 | Hatay | 335/52 |
| 2,067,235 | 1/1937 | Hedin | 335/52 |
| 2,070,741 | 2/1937 | Larson | 335/52 |
| 2,247,493 | 7/1941 | Harrison et al. | 335/52 |
| 2,303,371 | 12/1942 | Larson | 335/52 |
| 2,401,767 | 6/1946 | Larson | 335/56 |
| 2,474,000 | 6/1949 | Keating | 335/52 |
| 2,980,778 | 4/1961 | Hunciker | 335/50 |
| 3,187,142 | 6/1965 | Elenbaas | 335/53 |

*Primary Examiner*—Harold Broome

*Attorney, Agent, or Firm*—Albert L. Jeffers; Douglas L. Miller

[57] ABSTRACT

The disclosure relates to a mercury displacement relay and a method of making the same which utilizes a spring totally submerged within the mercury to support a movable displacement plunger. A cylindrical electrode contains the mercury, and the spring is uniquely connected to the bottom portion of the electrode. The spring opposite end is attached to a bottom portion of the displacement relay, which is received within the cylindrical electrode so that its bottom portion is submerged in the mercury. A pin electrode is also received within the cylindrical electrode and insulated therefrom. Adapted to the cylindrical electrode is a coil device, which, upon being energized, moves the plunger upwardly to cause the mercury to recede and break contact with the portion of the pin electrode in contact with the mercury. Upon deenergizing the coil device, the spring draws downwardly on the plunger to cause the mercury to rise and make contact again with the pin electrode.

12 Claims, 12 Drawing Figures

MERCURY DISPLACEMENT RELAY

BACKGROUND OF THE INVENTION

1. Field of the Invention

This invention pertains to a relay switch, and more particularly to a mercury displacement relay switch wherein the displacement plunger is supported by a spring submerged in the mercury body and which is uniquely secured within the relay.

2. Description of the Prior Art

The normally-closed mercury displacement relays of the prior art generally comprise a cylindrical electrode containing a body of mercury, a pin electrode sealed within the cylindrical electrode and insulated therefrom, the pin electrode further having a portion thereof in contact with the mercury, a displacement plunger within the cylindrical electrode and partially submerged within the mercury, and a coil means adapted to the cylindrical electrode for moving the displacement plunger from its first position to a second position above the first position upon being energized. The electrical connection is opened when the coil means is energized drawing the displacement plunger from its first position upwardly to its second position, whereby the mercury level recedes and breaks contact with the pin electrode.

The displacement plunger is generally positioned in its first position by either a spring or a weighted ballast. In the prior art relays which use a spring to position the displacement plunger in its first position, the spring is placed between and connected to the top of the displacement plunger and the bottom of the cover of the cylindrical electrode, and is maintained out of contact with the mercury body. The primary disadvantage of this structure is the presence of the spring within the arcing environment of the relay. Upon the making or breaking of electrical contact between the mercury body and the pin electrode, intense arcing occurs in the air space above the mercury body, which causes structural deformation and the eventual structural failure of the spring. This presents the undesirable circumstance of having to replace the whole mercury displacement relay due to the failure of the simple spring device therein.

In the normally-closed prior art mercury displacement relays utilizing the weighted ballast to maintain the displacement plunger in the first position, a problem different from that above occurs, which also makes this type relay undesirable to use. Since mercury has a specific gravity of 13.6, the weighted ballast must have a numerically high density in order to overcome the buoyant nature of the displacement plunger within the mercury body. The most commonly used weighted ballast having the required density characteristics is tungsten or a tungsten alloy, which is placed upon the top of the displacement plunger within the cylindrical electrode. Although the tungsten ballast is not undesirably affected by the arcing within the cylindrical electrode, its use as a weighted ballast in the manufacturing of a large number of relays becomes prohibitively costly.

Both relay devices above have their own distinct undesirable features and, consequently, the use of one in place of the other does not remove all of the problems described above.

SUMMARY OF THE INVENTION

The present invention provides an improved mercury displacement relay, and a method of making the same, which surmounts the above problems and disadvantages of the prior art. Specifically, the present invention remedies the arcing problem associated with the spring relay, thereby making its utilization practical and economical, while at the same time dispensing with the need of the alternate ballast relay and its associated problems. The removal of the arcing problem associated with the spring relay is accomplished by totally submerging the spring within the mercury body, thereby removing and protecting it from the arcing environment above the mercury body surface. The displacement plunger is then positioned in its first position by placing it on top of the spring and connecting it thereto. Upon energizing the coil means, the displacement plunger is drawn upwardly to cause the mercury to recede and break contact with the pin electrode. Upon deenergizing the coil means, the spring then draws the displacement plunger downwardly into the mercury causing it to rise within the cylindrical electrode and make contact with the pin electrode.

Furthermore, the present invention provides an innovative method for attaching the bottom of the spring to a bottom portion of the cylindrical electrode. Because of the small confines within the cylindrical electrode, conventional connections between the spring and the cylindrical bottom are not practical. To accomplish the connection, a method is provided which is feasible to use within the small confines of the cylindrical electrode. The spring may be welded to the bottom of the cylindrical electrode. Although this particular connection is practical, upon being welded, the steel of the spring tends to anneal, thereby losing its characteristics. Since the spring steel tends to lose its characteristics, it is often difficult to know whether or not the weld has produced a sufficiently strong connection without destructive testing, and it is particularly difficult to test or inspect the connection because of the small confines within the cylindrical electrode. Therefore, a tube is provided to be welded to the bottom of the cylindrical electrode and to have an end portion of the spring received therein. In this manner, the spring is properly secured to the bottom of the cylindrical electrode without causing any loss of its physical characteristics.

Generally stated, the present invention provides an improved mercury displacement relay which comprises an electrode containing a body of mercury, a pin electrode insulated from and secured within the first mentioned electrode and having a portion thereof in contact with the mercury, a displacement plunger within the electrode containing the mercury for moving the mercury level upwardly or downwardly upon energizing a coil device, a spring submerged within the mercury and having one end connected to the bottom of the displacement plunger, and a securing means for attaching the spring opposite end to the bottom of the electrode containing the mercury.

The method of the invention generally comprises providing a first electrode having a continuous side wall and a bottom wall, providing a displacement plunger, affixing an end of a spring to a bottom portion of the displacement plunger, placing the displacement plunger and spring within the first electrode, and connecting the spring opposite end to a bottom portion of the first electrode. Thereafter, filling partially the first electrode with a body of mercury so that the spring and the displacement plunger bottom portion remain submerged therein during operation of the relay. Also, securing a second electrode within the first electrode, insulating the electrodes from each other, and operating a coil device in proximity to the first electrode.

It is an object of the present invention to provide an improved mercury displacement relay wherein the spring is submerged within the mercury body, thereby removing it from the damaging arcing environment of the relay.

Another object of the present invention is to provide a method of attaching the spring to the bottom of the electrode containing the mercury without causing the structural characteristics of the spring to weaken.

It is another object of the present invention to provide a mercury displacement relay which is durable, and simple and economical to produce.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DETAILED DESCRIPTION

Figure 1:
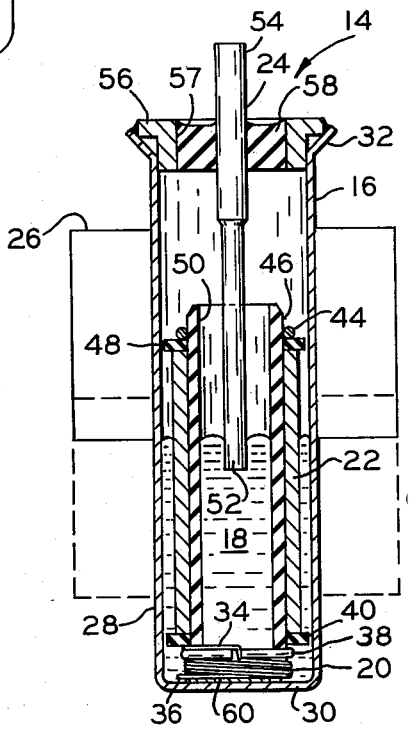
FIG. 1 is a sectional view of a normally-closed mercury displacement relay of the present invention.

Referring to FIG. 1, a normally-closed mercury displacement relay 14 of the present invention is illustrated and comprises cylindrical electrode 16, mercury body 18 contained within cylindrical electrode 16, spring 20, displacement plunger 22, pin electrode 24, and a coil device 26. Cylindrical electrode 16 further comprises continuous wall 28, bottom wall 30, and a shoulder 32 formed from continuous wall 28, and is partially filled with mercury body 18. Cylindrical electrode 16 is preferably made of a non-magnetic stainless steel material.

Figure 3:
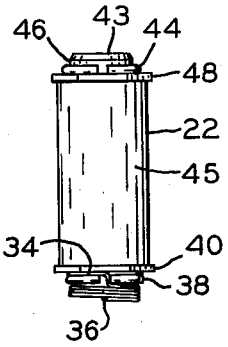
FIG. 3 is a side elevational view of a displacement plunger of the present invention.
Figure 4:
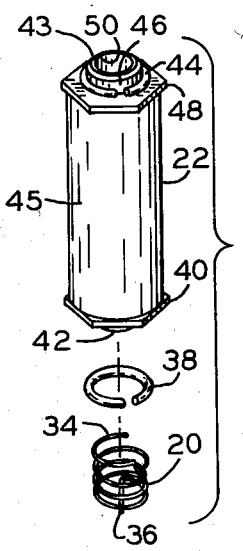
FIG. 4 is an exploded view in perspective of the displacement plunger of FIG. 3.

Spring 20 of mercury displacement relay 14 has a top end 34 and a bottom end 36. Top end 34 is secured to displacement plunger 22 by clip 38 about neck 42 of displacement plunger 22 which holds top end 34 against flange 40 of displacement plunger 22. Displacement plunger 22 illustrated in FIGS. 3 and 4 is of cylindrical shape and has a ceramic liner 43 with neck 42, 46 and plunger guide flanges 40, 48. A clip 44 is also provided, and plunger 22 has a hole 50 disposed longitudinally therethrough. A cover 45 of cylindrical shape is disposed about ceramic liner 43, and may be made of conventional ferromagnetic or similar material. It is noteworth to realize at this point that spring 20 and the bottom portion of displacement plunger 22 are totally submerged within mercury body 18 and, as described below, remain so during operation of mercury displacement relay 14.

Figure 2:
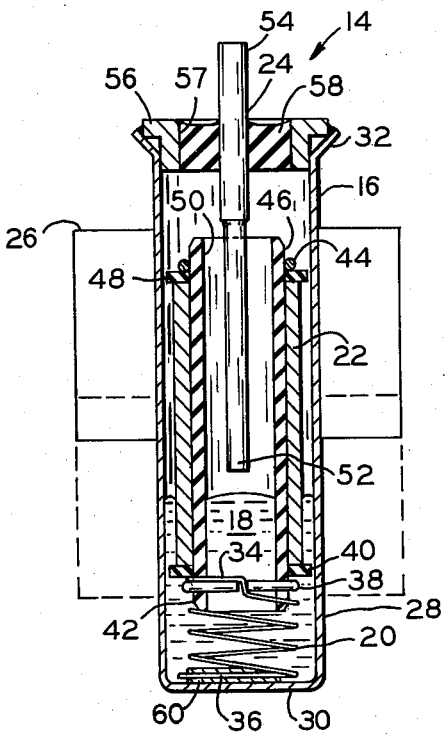
FIG. 2 is a sectional view of a normally-closed mercury displacement relay of the present invention with the coil means energized.

Pin electrode 24, which has bottom end 52 and top end 54, is received within cylindrical electrode 16 and hole 50 of displacement plunger 22 as illustrated in FIGS. 1 and 2. A cap 56, which has opening 57 disposed therethrough, is placed within and resistance welded to shoulder 32 of cylindrical electrode 16, and further has pin electrode 24 received through opening 57 and secured therein by glass insulation 58 between pin electrode 24 and cap 56.

Coil device 26 is positioned about cylindrical electrode 16 such that during its deenergized period displacement plunger 22 is positioned within cylindrical electrode 16 as illustrated in FIG. 1, and during its energized period displacement plunger 22 is positioned within cylindrical electrode 16 as illustrated in FIG. 2.

Figure 5:
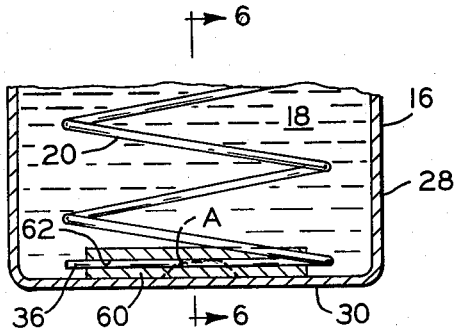
FIG. 5 is a partially broken away and enlarged sectional view of the bottom portion of a mercury displacement relay of the present invention.
Figure 6:
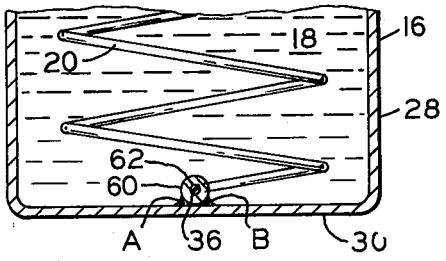
FIG. 6 is a sectional view of FIG. 5 taken along line 6—6 and viewed in the direction of the arrows.

Referring now to FIGS. 5–12, various means of attaching spring 20 to bottom wall 30 of cylindrical electrode 16 will be explained. A preferred mode of attachment is depicted in FIGS. 5 and 6 wherein bottom end 36 of spring 20 is received in hole 62 of tube 60. Tube 60, which has a length slightly less than the inside diameter of cylindrical electrode 16, is mesh welded or spot welded to bottom wall 30 at points "A" and "B".

Figure 7:
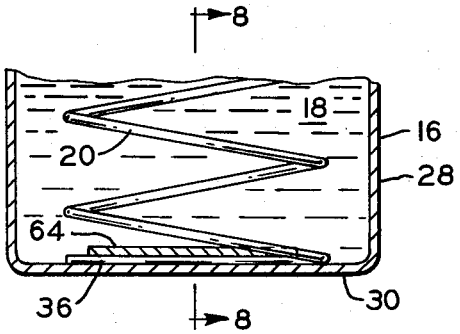
FIG. 7 is a partially broken away and enlarged sectional view of an alternate embodiment of a mercury displacement relay of the present invention.
Figure 8:
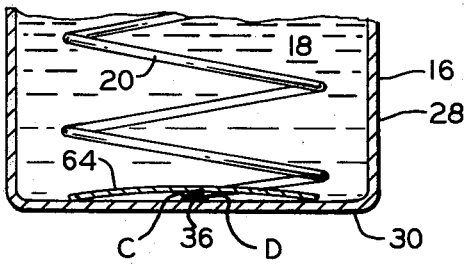
FIG. 8 is a sectional view of FIG. 7 taken along line 8—8 and viewed in the direction of the arrows.

A modification of the above securement of spring 20 to bottom wall 30 is illustrated in FIGS. 7 and 8. In this modification, tube 60 has been replaced by a plate such as concave-shaped disc 64. Disc 64 is placed over spring bottom end 36 and is then mesh welded or spot welded at its center to bottom wall 30 at points "C" and "D" such that the weld occurs between disc 64, end 36, and bottom wall 30. The function of disc 64 is to hold spring end 36 to bottom wall 30 even if spring end 36 becomes totally annealed upon welding. Again, the length of disc 64 is preferably slightly less than the inner diameter of cylindrical electrode 16 to ensure proper securement of spring 20 to bottom wall 30.

Figure 9:
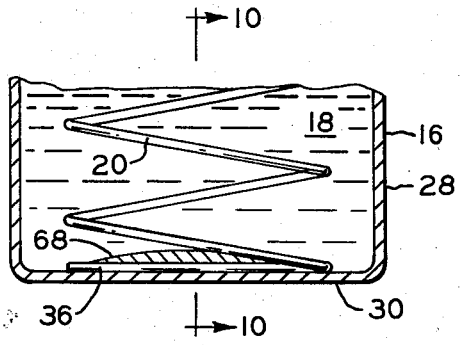
FIG. 9 is a partially broken away and enlarged sectional view of a third embodiment of a mercury displacement relay of the present invention.
Figure 10:
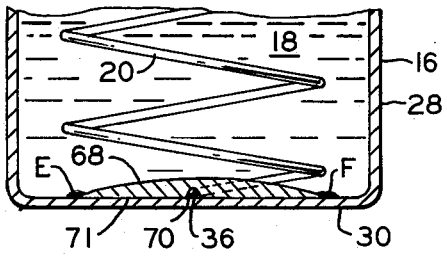
FIG. 10 is a sectional view of FIG. 9 taken along line 10—10 and viewed in the direction of the arrows.

A second modification of the attachment is depicted in FIGS. 9 and 10 where the plate is a dome-shaped disc 68 having a groove 70 disposed through its flat surface 71. Disc 68 is placed over spring bottom end 36 so that it lies within groove 70, and disc 68 is then secured to bottom wall 30 by mesh welding or spot welding at points "E" and "F". The preferred length of disc 68 is slightly shorter than the inside diameter of cylindrical electrode 16. Alternately, the weld may occur in the center of disc 68 in a manner similar to disc 64.

Figure 11:
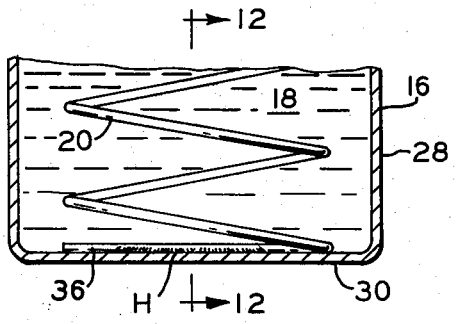
FIG. 11 is a partially broken away and enlarged sectional view of a fourth embodiment of a mercury displacement relay of the present invention.
Figure 12:
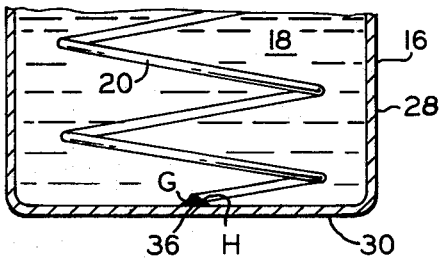
FIG. 12 is a sectional view of FIG. 11 taken along line 12—12 and viewed in the direction of the arrows.

FIGS. 11 and 12 show a third embodiment of the above attachment of spring 20 to bottom wall 30. In this modification, spring bottom end 36 is mesh welded or spot welded to bottom wall 30 at points "G" and "H".

During the period of time a closed circuit is desired, coil device 26 is maintained in a deenergized state such that displacement plunger 22 is partially submerged within mercury body 18 so that bottom end 52 of pin electrode 24 is in contact with mercury body 18 as depicted in FIG. 1. As long as pin electrode 24 is in contact with mercury body 18, a closed circuit exists between pin electrode 24, mercury body 18, and cylindrical electrode 16. During this deenergized state, spring 20 and the bottom portion of displacement plunger 22 are totally submerged within mercury body 18 out of the damaging arcing environment above the surface of mercury body 18.

Should it be desired to open the closed circuit described in the above paragraph, coil device 26 is energized, thereby creating an electromagnetic field about cylindrical electrode 16 which draws displacement plunger 22 upwardly within cylindrical electrode 16, causing mercury body 18 to recede and break contact with pin electrode 24. This open circuit is illustrated in FIG. 2, and it should again be noted that during the period of time the circuit is open, spring 20 and the bottom portion of displacement plunger 22 remain totally submerged within mercury body 18 and protected from the damaging arcing environment. Upon deenergizing coil device 26, the tension of spring 20 draws downwardly on displacement plunger 22 thereby causing mercury body 18 to rise and again make contact with pin electrode 24 as shown in FIG. 1.

The above structural and operational description pertains to a normally-closed mercury displacement relay. However, in view of the above description, it should be recognized that the same construction and principles may be adapted to a normally-open mercury displacement relay. In this embodiment, coil device 26 is illustrated in dotted lines in FIGS. 1 and 2, and spring 20 is of such nature as to maintain displacement plunger 22 in the position shown in FIG. 2 so that mercury body 18 is disengaged from pin electrode 24. Should a closed circuit be desired, it is only necessary to energize coil device 26 to create the electromagnetic field, thereby drawing displacement plunger 22 downwardly within cylindrical electrode 16 to cause mercury body 18 to rise and make contact with pin electrode 24. Upon deenergizing coil device 26, the expansible tension of compression spring 20 moves displacement plunger 22 upwardly to cause mercury body 18 to recede and break contact with pin electrode 24.

In the normally-open mercury displacement relay, the preferred attachment of spring 20 to bottom wall 30, and modifications thereof, as explained above are equally applicable.

While this invention has been described as having a specific embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A mercury displacement relay comprising:

a first electrode member containing a body of mercury therein, a second electrode member being received and secured within said first electrode member, said second electrode member having a portion thereof in contact with said mercury body, said electrodes being insulated one from the other, a displacement plunger having a first position within said first electrode member wherein a first length of said displacement plunger is submerged in said mercury body, and being movable to a second position within said first electrode member higher than said first position wherein a second length shorter than said first length of said displacement plunger is submerged in said mercury body, said displacement plunger first and second lengths having a common submerged portion, a spring having opposite ends and being submerged within said mercury body, a first one of said ends being attached to said displacement plunger common portion submerged in said mercury body, means submerged in said mercury body for securing an opposite end of said spring to a portion of said first electrode member in contact with said mercury body so that said displacement plunger is movably suspended in said first position by said spring, and coil means in proximity to said first electrode member for moving said displacement plunger from said first position to said second position upon being energized, whereby said mercury body is displaced downwardly upon said displacement plunger moving from said first to said second position, thereby disengaging said second electrode member portion from contact with said mercury body.

2. The relay of claim 1 wherein said securing means comprises a tube member having a portion of said spring opposite end received therethrough, said tube member being attached to said first electrode member portion in contact with said mercury body.

3. The relay of claim 1 wherein said securing means comprises a plate member being fitted over a portion of said spring opposite end, said plate member being attached to said first electrode member portion in contact with said mercury body and having said spring opposite end portion secured therebetween.

4. The relay of claim 1 wherein said securing means comprises a portion of said spring opposite end being attached to said first electrode member portion.

5. A mercury displacement relay comprising:

a first electrode member containing a body of mercury therein, a second electrode member being received and secured within said first electrode member and insulated therefrom, said second electrode member being disengaged from said mercury body, a displacement plunger having a first position within said first electrode member wherein a first length of said displacement plunger is submerged in said mercury body, and being movable to a second position within said first electrode member lower than said first position wherein a second length longer than said first length of said displacement plunger is submerged deeper in said mercury body, said displacement plunger first and second lengths having a common submerged portion, a spring having opposite ends and being submerged within said mercury body, a first one of said ends being attached to said displacement plunger common portion submerged in said mercury body, means submerged in said mercury body for securing an opposite end of said spring to a portion of said first electrode member in contact with said mercury body so that said displacement plunger is movably suspended in said first position by said spring, and coil means in proximity to said first electrode member for moving said displacement plunger from said first position to said second position upon being energized, whereby said mercury body is displaced upwardly upon said displacement plunger moving from said first to said second position, thereby engaging said second electrode member portion with said mercury body.

6. The relay of claim 5 wherein said securing means comprises a tube member having a portion of said spring opposite end received therethrough, said tube member being attached to said first electrode portion in contact with said mercury body.

7. The relay of claim 5 wherein said securing means comprises a plate member being fitted over a portion of said spring opposite end, said plate member being attached to said first electrode member portion in contact with said mercury body and having said spring opposite end portion secured therebetween.

8. The relay of claim 5 wherein said securing means comprises a portion of said spring opposite end being attached to said first electrode member portion.

9. A method of making a mercury displacement relay, comprising:

providing a first electrode member having a continuous side wall and a bottom wall, supplying a displacement plunger having opposite ends, furnishing a spring having opposite ends, affixing an end of the spring to a bottom portion of the displacement plunger, positioning the displacement plunger and spring affixed thereto within the first electrode member, connecting the spring opposite end to a bottom portion of the first electrode member, filling partially the first electrode member with a body of mercury so that the spring and the displacement plunger bottom portion remain submerged therein during operation of the relay, securing a second electrode member within the first electrode member, insulating the electrode members from each other, and operating a coil means in proximity to the first electrode member for moving the displacement plunger from a first position in the mercury body to a second position in the mercury body, the displacement plunger bottom portion and the spring being maintained in contact with the mercury body between the first and second positions.

10. The method of claim 9 wherein the step of connecting the spring opposite end includes:

providing a tube member, inserting a portion of the spring opposite end through the tube member, and attaching the tube member to the portion of the first electrode member in contact with the mercury body.

11. The method of claim 9 wherein the step of connecting the spring opposite end includes:

providing a plate member, fitting the plate member over a portion of the spring opposite end, and attaching the plate member to the portion of the first electrode member in contact with the mercury body so that the spring opposite end portion is between the plate member and the first electrode member portion.

12. The method of claim 9 wherein the step of connecting the spring opposite end includes:

providing an end portion of the spring opposite end, and attaching the end portion to the first electrode member portion in contact with the mercury body.

* * * * *